US007003846B2

(12) United States Patent
Holtz

(10) Patent No.: US 7,003,846 B2
(45) Date of Patent: Feb. 28, 2006

(54) VACUUM AND DISPOSAL SYSTEM FOR ANIMAL FECES

(75) Inventor: Carl Michael Holtz, Monticello, IL (US)

(73) Assignee: Holtz Engineering, Ltd., Monticello, IL (US)

( * ) Notice: Subject to any disclaimer, the term of this patent is extended or adjusted under 35 U.S.C. 154(b) by 271 days.

(21) Appl. No.: 10/403,348

(22) Filed: Apr. 1, 2003

(65) Prior Publication Data

US 2004/0194248 A1 Oct. 7, 2004

(51) Int. Cl.
*A47L 5/24* (2006.01)

(52) U.S. Cl. ..... 15/344; 15/327.1; 15/352

(58) Field of Classification Search ..... 15/327.1, 15/327.5, 327.7, 341–344, 347, 352, 402; 134/21

See application file for complete search history.

(56) References Cited

U.S. PATENT DOCUMENTS

| | | | | | |
|---|---|---|---|---|---|
| 1,105,942 | A | * | 8/1914 | Waring | 92/37 |
| 1,797,557 | A | * | 3/1931 | Stine et al. | 43/139 |
| RE23,524 | E | * | 7/1952 | Denman | 56/332 |
| 2,665,445 | A | * | 1/1954 | Foerstel et al. | 15/344 |
| 3,210,916 | A | * | 10/1965 | Jepson | 55/471 |
| 3,238,556 | A | * | 3/1966 | Martin | 15/330 |
| 3,866,264 | A | * | 2/1975 | Engquist | 15/421 |
| 4,074,458 | A | * | 2/1978 | Catlett | 43/139 |
| 4,102,547 | A | | 7/1978 | Williams | |
| 4,185,355 | A | | 1/1980 | Williams | |
| 4,663,799 | A | | 5/1987 | Kiyooka | |
| 5,174,620 | A | | 12/1992 | Huegelmeyer et al. | |
| 5,661,873 | A | | 9/1997 | Karet | |
| 5,679,535 | A | * | 10/1997 | Joyce et al. | 435/7.9 |
| 5,771,531 | A | * | 6/1998 | Swartz | 15/344 |
| 6,066,211 | A | * | 5/2000 | Sandell | 134/21 |
| 6,115,879 | A | | 9/2000 | Mitchell | |
| 6,618,898 | B1 | * | 9/2003 | Tingle | 15/347 |
| 6,880,873 | B1 | * | 4/2005 | Stoev | 294/1.4 |

FOREIGN PATENT DOCUMENTS

| | | | |
|---|---|---|---|
| DE | 19540862 | * | 4/1997 |
| FR | 2843763 | * | 2/2004 |
| JP | 3-140130 | * | 6/1991 |
| JP | 10-155705 | * | 6/1998 |
| KR | 99033892 | * | 5/1999 |

* cited by examiner

*Primary Examiner*—Terrence R. Till
(74) *Attorney, Agent, or Firm*—Knechtel, Demeur & Samlan

(57) ABSTRACT

A vacuum and disposal system for the collection and disposal of animal feces. The vacuum and disposal system consists of a vacuum source, a vacuum tube, a flexible hose, and an intake tube. The vacuum is provided by an electric motor powered by a rechargeable battery and is used to create a vacuum or suction through the vacuum tube, the flexible hose, and the intake tube to collect the animal feces. A cartridge having a filter is inserted into the intake tube to receive the animal feces collected. After collection, the vacuum and disposal system is converted to an unload position for the removal of the cartridge from the intake tube and the ultimate disposal of the animal feces. Alternatively, a compact vacuum and disposal system may be used in smaller areas.

13 Claims, 4 Drawing Sheets

VACUUM AND DISPOSAL SYSTEM FOR ANIMAL FECES

I. FIELD OF THE INVENTION

The present invention relates to an animal feces vacuum and disposal system and, more particularly, to a vacuum device that utilizes a unique cartridge system for collecting and disposing of animal feces.

II. DESCRIPTION OF THE PRIOR ART

Animal feces can be found in lawns or grassy areas, sidewalks, playgrounds, parks, and in some instances, within homes where untrained household pets defecate. For property and pet owners, the new or abandoned animal feces must be removed from these and other locations.

In the past, several devices have been developed to address the animal feces removal problem. For example, U.S. Pat. No. 4,185,355 entitled "Apparatus For Cleaning Up Animal Feces Deposits" discloses a method and apparatus for cleaning up an animal feces deposit from a situs. The device cleans up the feces by positioning an open-ended receptacle with its open end overlying and in close proximity to the animal feces deposit, providing a suction to pick up the animal feces deposit, and delivering the same into the interior of the receptacle for the receptacle to be removed from the device and discarded. This device, however, contains inherent problems relating to the removal of animal feces. First, as the device is a very small hand held unit, the entire unit must be placed almost on the ground to properly align the nozzle opening with the feces. For those persons unable to bend down due to their leg or back problems, this device is useless. Also, for those persons with eye sight or depth perception problems, aligning the nozzle opening with the feces will be a problem considering the device blocks the person's view from multiple angles. Second, the device requires a tube that must be attached and removed form the device multiple times during the operation of the device. For persons without the proper hand strength, this would render the device useless. For the others, this step is an unnecessary inconvenience. Third, the bag and the nozzle opening are perpendicular to one another which means that, when the feces is received into the device, it must be redirected through ninety degrees for collection into the bag. For feces that is firm but compressible, the feces typically will attach to the bag upon entry and never reach the back of the bag. This creates an accumulation in the opening that reduces the further retrieval of the feces into the device and ultimately limits the usefulness of the device and that particular bag.

Lastly, the removal of the bag from the device presents difficulty. As illustrated, the bag is significantly larger than the diameter of the tube. Since the bag is removed through the tube, removing a bag full of feces can only be done a portion at time and the user must exercise care to prevent any feces from spilling out of the bag. If, due to the fullness of the bag it gets stuck on the rim of the tube, there is a good possibility that the bag may break causing a terrible mess within the device. Additionally, if the bag does get stuck, the user may be forced to use their hand to displace the feces and, thereby, dislodge the bag from being stuck to the tube. In either event, removing the bag from the device is cumbersome and creates potential problems during every use.

The small hand held problem presented above is addressed in U.S. Pat. No. 5,661,873 entitled "Animal Waste Vacuum With Disposable Pickup Tool & Disposable Container" which discloses a vacuum system that provides a compact power unit to collect animal waste through a long disposable intake tube and into a storage container. Likewise, U.S. Pat. No. 5,771,531 entitled "Vacuum For Animal Feces" illustrates a vacuum device for pet feces that picks up the feces through an elongated tube and deposits it into a bag in the receptacle for disposal. Similarly, U.S. Pat. No. 6,115,879 entitled "Vacuum Cleaner" illustrates a vacuum cleaner that picks up debris and stores it in the canister for disposal. The problem with all of these devices is that they are not sanitary in that the elongated tubes must be cleaned after each use. Also, like the '355 Patent, each device provides complex issues and problems for the insertion, attachment, use, and removal of the feces.

Other patented devices include U.S. Pat. No. 5,174,620 entitled "Manually Operated Animal Waste Collector" which illustrates a manually operated device for collecting pet feces and U.S. Pat. No. 4,102,547 entitled "Scavenging Device For Animal Waste" which discloses a two compartment box container for collecting pet feces. These devices, however, do not provide or disclose the unique vacuum and disposal system of Applicant's device.

U.S. Pat. No. 4,663,799 entitled "Dust Collector" illustrates a dust collecting device that can both vacuum and blow but is not designed to pick up and/or dispose of animal feces.

Thus, there is a need and there has never been disclosed a vacuum device that utilizes a unique cartridge system for collecting and easily disposing of animal feces.

III. OBJECTS OF THE INVENTION

It is the primary object of the present invention to provide a device that removes animal feces from undesired locations and utilizes a unique cartridge and filter to easily dispose of the animal feces.

A related object of the present invention is to provide an animal feces vacuum device that minimizes the inadvertent discharge of feces from the device.

Another object of the present invention is to provide a device that is light weight and portable. A related object of the present invention is to provide a quality vacuum and disposal system that is inexpensive to manufacture.

Still another object of the invention is to provide a device that is safe, sanitary, and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is a vacuum and disposal system for the collection and disposal of animal feces. The vacuum and disposal system consists of a vacuum, a vacuum tube, a flexible hose, and an intake tube. The vacuum is created by an electric motor powered by a rechargeable battery and is used to create a suction through the vacuum tube, the flexible hose, and the intake tube to collect the animal feces. A cartridge is inserted into the intake tube to receive the animal feces collected. After collection, a slide mechanism, a bracket, a guide, a cable, spring loaded hinges, and a rotating support frame coact to enable the vacuum and disposal system to be converted into an unload position for the removal of the cartridge from the intake tube and the ultimate disposal of the animal feces. Alternatively, a compact vacuum and disposal system may be used in smaller areas.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
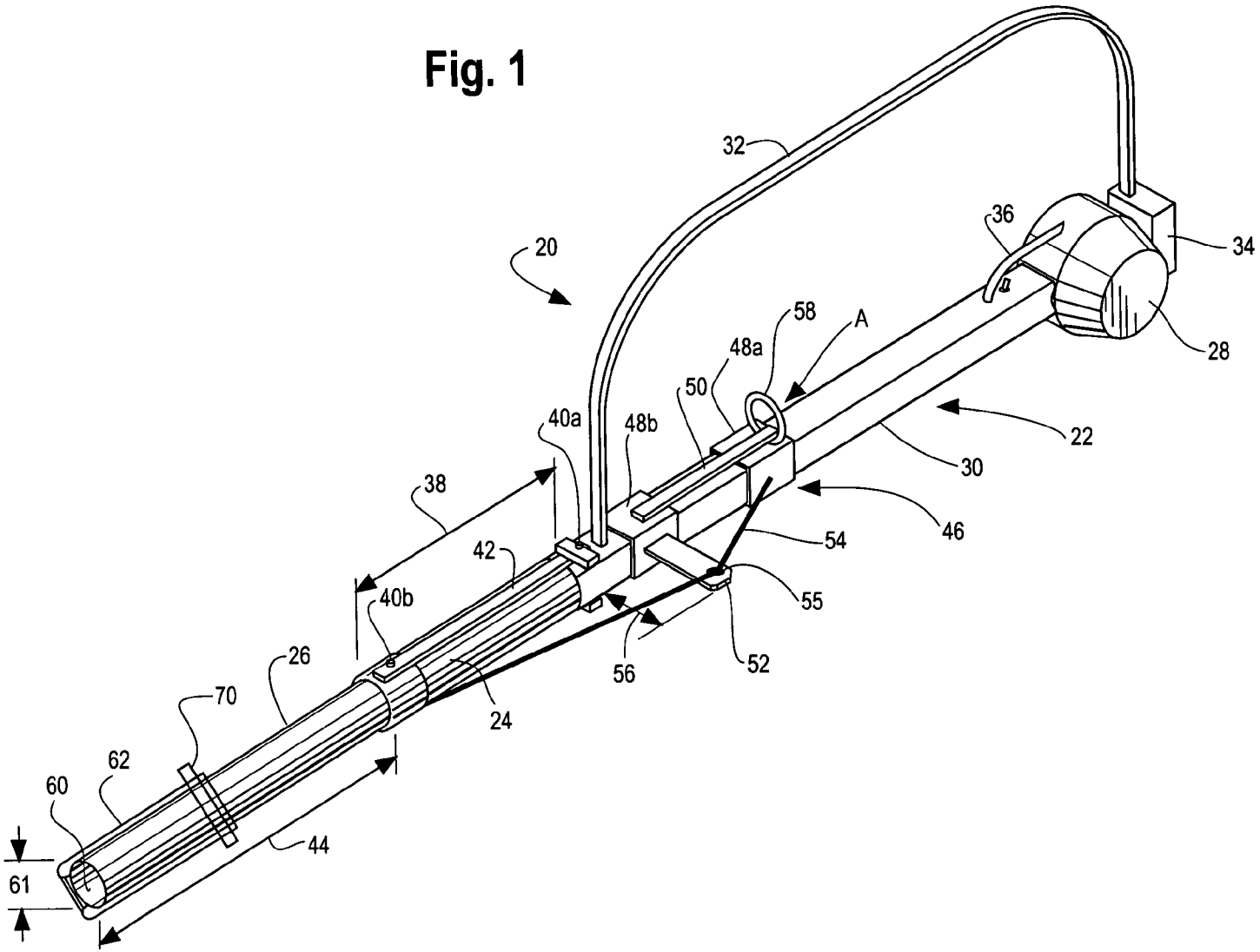
FIG. 1 is a front perspective view of the vacuum and disposal system in the open position.

Turning first to FIG. 1, there is illustrated a vacuum and disposal system 20. The system 20 consists of a vacuum 22, a flexible hose 24, and an intake tube 26.

The vacuum system 22 comprises an electric motor 28, a vacuum tube 30, and a shoulder strap 32. The electric motor 28 is powered by a battery 34. As the vacuum system 22 is a portable unit, it is preferable that the battery 34 be rechargeable by means of a conventional recharger powered by a 115 volt AC power source. An on/off switch 36 is provided to enable the vacuum system 22 to be energized when the on/off switch 36 is toggled to the on position and turned off when the on/off switch 36 is toggled to the off position. When the vacuum system 22 is in the on position, the vacuum system 22 is powered by the electric motor 28 to create a suction within the vacuum tube 30. The exact amount of suction will depend upon the size of the vacuum system 22 and the various suction capacities necessary to accommodate the amount of fecal material generated by different sizes of animals or pets. Various motors 28 are on the market today to provide the appropriate suction through the vacuum tube 30.

The flexible hose 24 is a hollow, cylindrical member having a length 38. The flexible hose 24 is attached, at one end, to the vacuum tube 30 of the vacuum system 22. At the other end, the flexible hose 24 is attached to the intake tube 26. In the preferred embodiment, the flexible hose 24 is attached to the vacuum tube 30 and the intake tube 26 by spring loaded hinges 40*a,b*. In the preferred embodiment, the hinges 40*a,b* do not protrude into the airflow chamber or provide an obstruction within the hollow intake tube 26 or vacuum tube 30. A rotating support frame 42 is located on both sides of the flexible hose 24 and connected lengthwise along the flexible hose 24 from the spring loaded hinge 40*a* to the spring loaded hinge 40*b*. The intake tube 26 is a hollow, cylindrical member which extends outwardly a tube length 44 from the flexible hose 24. Preferably, the intake tube 26 has a tube length 44 of approximately two feet. Alternatively, it is contemplated that the intake tube 26 may have a tube length 44 as small as one foot for a compact unit without a flexible hose 24. The intake tube 26 is made of a durable, cleanable, plastic material. Alternatively, the intake tube 26 may be made of stainless steel material.

Located at the opposite end of the intake tube 26 from the flexible hose 24 is an opening 60. Preferably, the opening 60 has a diameter 61 which is approximately one and one half inches (1½) inches. Depending on the suction in the vacuum tube 30, the diameter 61 may be appropriately sized between one and one half (1½) inches to three (3) inches. In the preferred embodiment, a cartridge 62 is inserted into the opening 60. The detailed description of the cartridge 62 is discussed in further detail below.

A slide mechanism 46 is attached to the vacuum tube 30 of the vacuum system 22. The slide mechanism 46 consists of collars 48*a,b* connected together by a control rod 50. Extending perpendicular from the side of collar 48*b* is a bracket 52. The bracket 52 facilitates the connection of a cable 54 (i.e., passes through a swivel guide 55 located at the end of the bracket 52), from the collar 48*a* to the exterior of the intake tube 26. In the preferred embodiment, the bracket 52 has a bracket length 56 sufficient to: (a) prevent the cable 54 from coming in contact with the flexible hose 24 and interfering with the connection of the cable 54 to the intake tube 26, and (b) provides a means to connect the slide mechanism 46 to the intake tube 26 where each exist in the same plane or in tandem. Preferably, the cable 54 is made of a flexible galvanized steel wire or nylon rope material. The separation between collars 48*a* and 48*b* may be greater or less provided that the cable 54 connects the slide mechanism 46 to the intake tube 26 in the manner described herein. A ring shaped handle is also affixed to the collar 48*a*.

Figure 2:
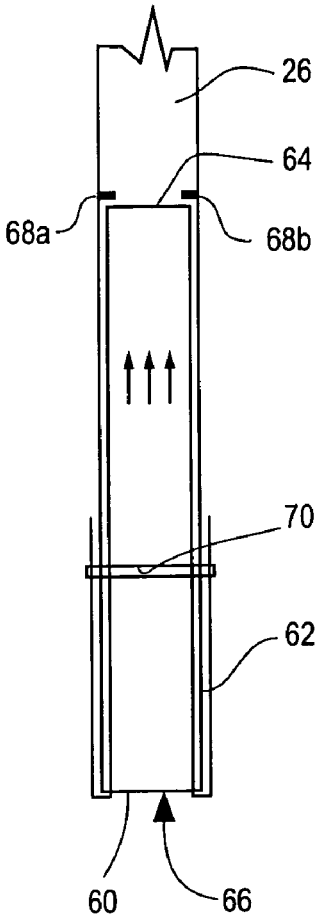
FIG. 2 is a side view of the cartridge as inserted into the intake tube, with portions removed.

Turning to FIG. 2, the insertion of the cartridge 62 into the intake tube 26 is more clearly illustrated. Preferably, the cartridge 62 is made of a plastic material. Alternatively, the cartridge 62 may be made of a biodegradable material similar to that used for garbage bags. In the preferred embodiment, the cartridge 62 is a hollow elongated member having two ends: a cartridge closed end 64 and a cartridge open end 66. The closed end 64 of the cartridge 62 is inserted directly into the opening 60 and received by the intake tube 26. The cartridge 62 is received along the interior walls of the intake tube 26 until is contacts detent members 68*a* and 68*b*. The detent members 68*a* and 68*b* provide a stopping mechanism to prohibit the cartridge 62 from being inserted any further into the intake tube 26. In the preferred embodiment, the detent members 68*a* and 68*b* are located approximately six (6) inches from the opening 60 of the intake tube 26. The reason for this is to allow approximately 10.5 cubic inches of the cartridge 62 (i.e., 6 inches×1½ inch in diameter of the cartridge 62) to be received into the intake tube 26 which is sufficient for most animal applications. Alternatively, it is contemplated that more or less of the cartridge 62 may be inserted into the intake tube 26 depending upon the size of the intake tube 26. The remainder of the cartridge 62 not received into the intake tube 26 is folded over the exterior of the opening 60 and aligned along the exterior of the intake tube 26, as illustrated. In this manner, the open end 66 of the cartridge 62 forms a diameter substantially equal to the diameter 61 (FIG. 1) of the opening 60 of the intake tube 26. In the preferred embodiment, the cartridge 62 is affixed to the exterior of the intake tube 26 by a wire strip or twist tie 70.

Figure 6:
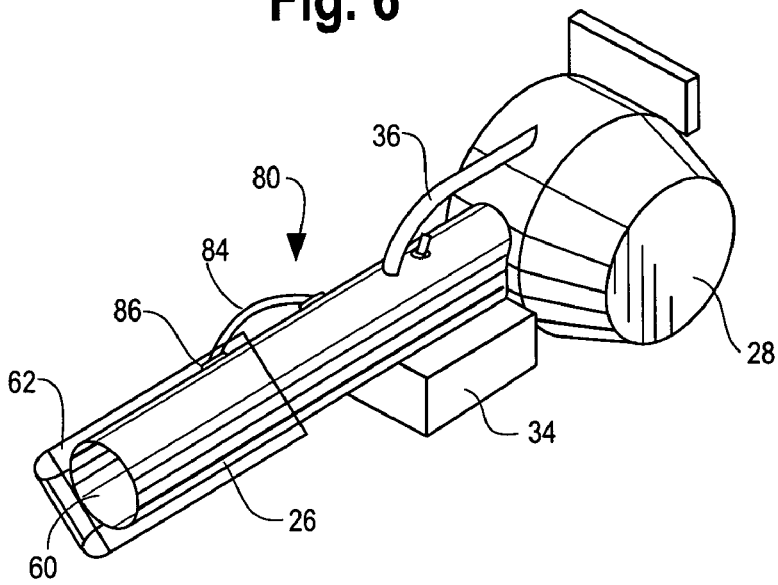
FIG. 6 is a front perspective view of an alternate embodiment of the vacuum and disposal system in the operative position.
Figure 7:
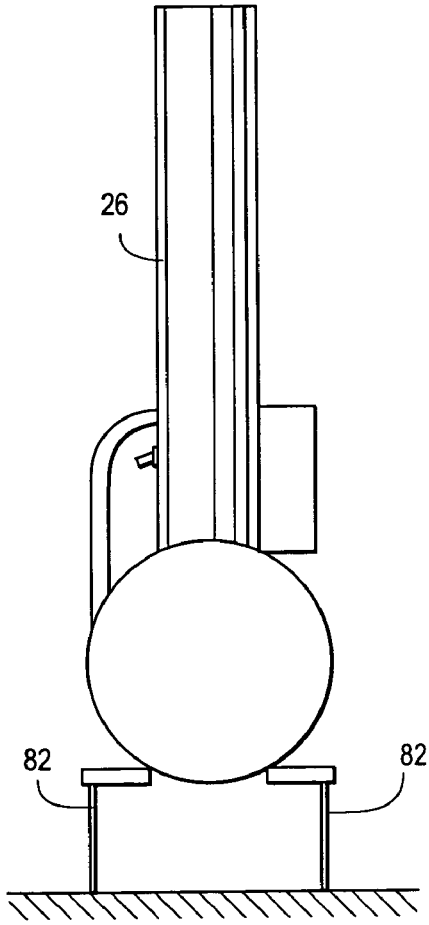
FIG. 7 is a side view of the alternate embodiment of the vacuum and disposal system in the unload position.

Alternatively, the cartridge 62 may be affixed to the exterior of the intake tube 26 by small metal or plastic strips 84 as illustrated in FIG. 6. One end of the metal strips is attached to the exterior of the intake tube 26 with the other end of the metal strip having a blunted detent member 86 that is pulled away from the intake tube 26 to receive the cartridge 62 and then released for pressing firmly against the exterior of the intake tube 26 thereby holding the cartridge 62 in position.

Figure 3:
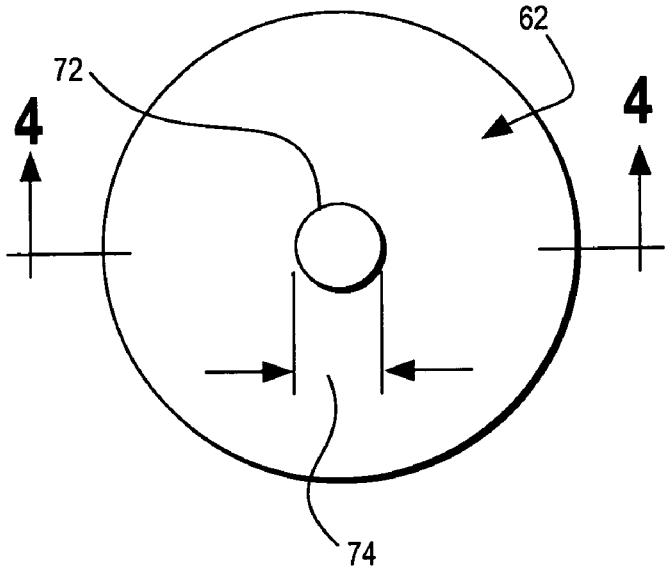
FIG. 3 is an enlarged end view of the cartridge and filter construction.
Figure 4:
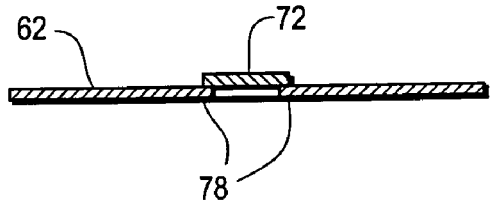
FIG. 4 is a cross section, taken from FIG. 3, of the cartridge and filter illustrating the attachment of the two components.

Centrally located at the cartridge closed end 64 is a filter 72 as illustrated in FIG. 3. The purpose of the filter 72 is twofold: (1) to enable the suction air to pass through the intake tube 26 and the vacuum and disposal system 20, and (2) to restrict the fecal material, solid, compressible, or liquid, from going past the intake tube 26, into the flexible hose 24, into the vacuum tube 30 and into the motor 28. The fecal material is thus retained within the cartridge 62 for disposal. There are many commercially available filter materials that achieve the above goal. Preferably, the filter 72 is an intertwined web mesh, a non porous material, or any other material that is commercially available which is sufficient to accomplish the dual purposes of the filter 72. It is also further contemplated that anyone skilled in the art could develop or manufacture any new filter 72 based upon variations or combinations of materials that are known to accomplish the intended results. The filter 72 has a filter diameter 74 which is larger than the diameter 61 of the intake tube 26. Preferably, the filter diameter 74 is approximately two (2) inches larger than diameter 61 of the intake tube 26 and the cartridge 62 has a hole in the center with a diameter that is slightly larger than diameter 61 of the intake tube. In this manner, neither the cartridge 62 nor the filter 72 constrict any of the suction air passing through the intake tube 26. The amount of material of the filter 72 that exceeds the diameter 61 of the intake tube 26 is preferably overlapped with the cartridge 62 material as illustrated in FIG. 4. In the preferred embodiment, the filter 72 and the cartridge 62 are affixed together to form the cohesive material 76 using a glue 78. The glue is preferably a commercially available water repellent adhesive that is compatible with the plastic and filter material. Alternatively, it is contemplated that any other means may be used to affix the filter 72 to the cartridge 62 provided that the means is sufficient to withstand the pressure of the suction generated by the vacuum system 22.

Figure 5:
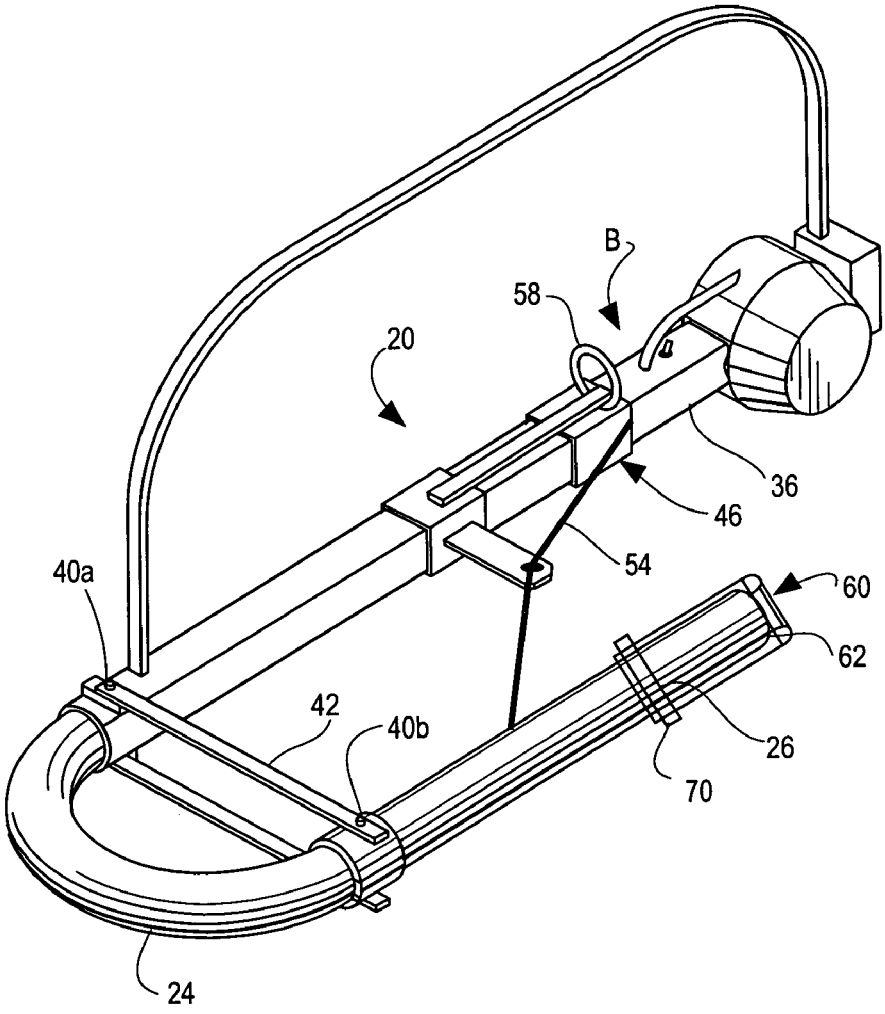
FIG. 5 is a front perspective view of the vacuum and disposal system in the unload position.

In use, a portion of the cartridge 62 is inserted, as discussed above, into the intake tube 26 of the vacuum and disposal system 20. The vacuum and disposal system 20 is held by the user with the shoulder strap 32 providing an easier holding or carrying means. The on/off switch 36 is toggled to the on position generating power to the system 20 and creating a vacuum or suction through the intake tube 26, the flexible hose 24, and the vacuum tube 30, all aligned in the same plane or the "open position." Upon viewing a animal feces to be removed, the opening 60 of the intake tube 26 is placed over the fecal material such that the vacuum or suction lifts the fecal material from the ground or resting location and pulling it inside the opening 60. The suction air and the fecal material travel along the interior of the intake tube 26 until the fecal material is retained by the cartridge 62 and/or filter 72. Once the fecal material is removed and retained within the cartridge 62, the vacuum and disposal system 20 is converted to the "unload position", as illustrated in FIG. 5, to prevent the fecal material from exiting the system 20 when the on/off switch is toggled to the off position and the vacuum or suction dissipates. To convert the system from the open position to the unload position, the ring shaped handle 58 is pulled lengthwise along the vacuum tube 30, from position A (FIG. 1) to position B (FIG. 5). In this manner, the slide mechanism 46 uses the cable 54 to apply an outward pulling force upon the intake tube 26. Under the pressure, the flexible hose 24 succumbs and, as the slide mechanism 46 traverses from position A to position B, the intake tube 26 is rotated through 180 degrees such that the opening 60 of the intake tube 26 faces in the opposite direction and pointing away from the ground. The spring loaded hinges 40*a,b* and the rotating support frame 42 coact along with the cable 54 to assist in the effective 180 degree rotation of the intake tube 26. Once the vacuum and disposal system 20 is in the unload position, the on/off switch 36 is toggled to the off position and the vacuum and suction is dissipated. Since the vacuum and disposal system 20 is in the unload position, the fecal material cannot accidentally exit the intake tube 26. The twist tie 70 is then removed and the cartridge 62 is removed from the intake tube 26 for disposal of the fecal material. It is contemplated that the wire strip or twist tie 70 or a flexible band may be used to seal the cartridge for disposal. After disposal, a new cartridge 62 is inserted into the intake tube 26 and the vacuum and disposal system 20 is returned to the open position for subsequent use.

In an alternate embodiment, a compact vacuum and disposal system 80, as illustrated in FIG. 6, may be used in the same manner for retrieving animal feces. The compact vacuum and disposal system 80 is operated and used in the same manner as disclosed herein. The only difference between this compact version and the original embodiment is that the intake tube 26 is not rotated 180 degrees to prevent the fecal material from exiting the system when the on/off switch 36 is toggled to the off position. Instead, prior to the on/off switch 36 being toggled to the off position, the entire compact vacuum and disposal system 80 is rotated and placed on retractable feet 82 such that the intake tube faces in the opposite direction of the ground to retain the animal feces until the cartridge 62 may be removed.

Thus, there has been provided a vacuum and disposal system that utilizes a unique cartridge and filter to coact with the intake tube for the retrieval and disposal of animal feces. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A vacuum and disposal apparatus for retrieving and disposing of animal feces, comprising:

a vacuum motor controlled by an on/off switch to toggle the vacuum motor between an on position and an off position, the vacuum motor providing suction through a hollow, vacuum tube;

a hollow, flexible hose having opposed ends, one opposed end of the flexible hose attached to the vacuum tube;

a hollow, intake tube having a first end and a second end, the first end attached to the other opposed end of the flexible hose, the second end of the intake tube providing an opening;

a cartridge having a closed end and an open end, the closed end of the cartridge being received into the opening of the intake tube and covering a portion of the interior of the intake tube with the open end of the cartridge coinciding with the opening in the intake tube, the remainder of the cartridge extending outwardly from the intake tube and being folded over for covering a portion of the exterior of the intake tube;

a slide mechanism affixed to the exterior of the vacuum tube, a bracket extending outwardly and perpendicular to the slide mechanism;

a cable connecting the slide mechanism to the intake tube using the bracket for pivoting the intake tube from a first operating position to a second, unload position;

whereby, upon the vacuum motor being toggled to the on position and the opening of the intake tube being placed over animal feces, the animal feces is sucked into the opening and received into the cartridge for disposal.

2. The vacuum and disposal apparatus of claim 1 and further comprising a swivel guide to receive and guide the cable to the intake tube.

3. The vacuum and disposal apparatus of claim 1 wherein the slide mechanism is traversed along the longitudinal axis of the vacuum tube for converting the apparatus from the open position to the unload position for disposing of the animal feces.

4. The vacuum and disposal apparatus of claim 3 wherein the intake tube is rotated through substantially one hundred and eighty degrees for converting the apparatus from the open position to the unload position.

5. The vacuum and disposal apparatus of claim 1 wherein the cartridge is secured to the exterior of the intake tube by a wire strip or twist tie.

6. The vacuum and disposal apparatus of claim 1 wherein the cartridge is secured to the exterior of the intake tube by a metal strip.

7. The vacuum and disposal apparatus of claim 1 wherein the vacuum tube, the flexible hose, and the intake tube are attached by spring loaded hinges.

8. A vacuum and disposal apparatus for retrieving and disposing of animal feces, comprising:

a vacuum motor controlled by an on/off switch to toggle the vacuum motor between an on position and an off position, the vacuum motor providing suction through a hollow, vacuum tube;

a hollow, flexible hose having opposed ends, one opposed end of the flexible hose attached to the vacuum tube;

a hollow, intake tube having a first end and a second end, the first end attached to the other opposed end of the flexible hose, the second end of the intake tube providing an opening;

a cartridge having a closed end and an open end, the closed end of the cartridge being received into the opening of the intake tube and covering a portion of the interior of the intake tube with the open end of the cartridge coinciding with the opening in the intake tube, the remainder of the cartridge extending outwardly from the intake tube and being folded over for covering a portion of the exterior of the intake tube;

a rotating support frame affixed lengthwise along the flexible hose between the vacuum tube and the intake tube;

whereby, upon the vacuum motor being toggled to the on position and the opening of the intake tube being placed over animal feces, the animal feces is sucked into the opening and received into the cartridge for disposal.

9. A vacuum and disposal apparatus for retrieving and disposing of animal feces, comprising:

a hollow, intake tube having a first end and a second end, the first end of the intake tube providing an opening;

means for providing suction through the intake tube;

a cartridge having a body with an open end and a closed end, the closed end of the cartridge being received into the opening of the intake tube with the exterior of the body aligning adjacent to and covering the interior of the intake tube with the opening of the intake tube remaining substantially the same size, the remainder of the body extending outwardly from the intake tube and being folded over for covering a portion of the exterior of the intake tube;

a filter disposed over the closed end;

retractable feet to support the apparatus when the opening of the intake tube is positioned perpendicular to the relative ground;

whereby, upon the opening of the intake tube being placed over animal feces, the animal feces is sucked into the opening and received into the cartridge for disposal.

10. The vacuum and disposal apparatus of claim 9 wherein the means for providing suction through the intake tube is by an electric motor and fan in fluid communication with the second end of the intake tube.

11. The vacuum and disposal apparatus of claim 9 wherein the cartridge is secured to the exterior of the intake tube by a wire strip or twist tie.

12. The vacuum and disposal apparatus of claim 9 wherein the cartridge is secured to the exterior of the intake tube by a metal strip.

13. A method for using a vacuum to retrieve and dispose of waste debris, comprising the steps of:

providing a hollow, intake tube having a first end and a second end, the first end of the intake tube providing an opening, means for providing suction through the intake tube;

inserting a cartridge into the opening of the intake tube, the cartridge having a closed end and an open end, the closed end of the cartridge being received into the opening of the intake tube, the remainder of the cartridge extending outwardly from the intake tube and being folded over and covering the interior and the exterior of the intake tube;

securing the cartridge to the exterior of the intake tube;

providing the vacuum through a vacuum tube, a flexible hose, and the intake tube, the flexible hose having opposed ends, one opposed end attached to the vacuum tube and the other opposed end attached to the second end of the intake tube;

retrieving the waste debris by placing the intake tube over the waste debris, the waste debris being sucked into the opening and received into the cartridge;

converting the intake tube from an open position to an unload position by rotating the intake tube through substantially one hundred and eighty degrees, the intake tube being rotated using a slide mechanism affixed to the exterior of the vacuum tube, a bracket extending outwardly and perpendicular to the slide mechanism, and a cable connecting the slide mechanism to the intake tube;

removing the vacuum;

removing the cartridge from the intake tube; and disposing of the cartridge containing the waste debris.

* * * * *